US005217071A

United States Patent [19]

Ferry et al.

[11] Patent Number: 5,217,071

[45] Date of Patent: Jun. 8, 1993

[54] PRODUCTION TUBE WITH INTEGRATED HYDRAULIC LINE

[75] Inventors: Jean-Claude Ferry, Arthez de Bearn; Jean Boulet, Paris, both of France

[73] Assignee: Societe Nationale Elf Aquitaine (Production), France

[21] Appl. No.: 838,225

[22] PCT Filed: Jun. 26, 1991

[86] PCT No.: PCT/FR91/00507

§ 371 Date: Apr. 6, 1992

§ 102(e) Date: Apr. 6, 1992

[87] PCT Pub. No.: WO92/00437

PCT Pub. Date: Jan. 9, 1992

[30] Foreign Application Priority Data

Jun. 29, 1990 [FR] France ..... 90 08222

[51] Int. Cl.[5] ..... E21B 17/10

[52] U.S. Cl. ..... 166/242

[58] Field of Search ..... 166/65.1, 72, 242, 89; 285/22, 91

[56] References Cited

U.S. PATENT DOCUMENTS

| | | | |
|---|---|---|---|
| 2,445,249 | 3/1946 | Sproull | 285/22 |
| 3,763,932 | 10/1973 | Dinning | 166/72 |
| 3,780,802 | 12/1973 | Phipps et al. | 166/89 |
| 3,844,345 | 10/1974 | Evans et al. | 166/72 |
| 4,086,935 | 5/1978 | Raulins et al. | 137/522 |
| 4,200,297 | 4/1980 | Tricon | 277/102 |
| 4,337,969 | 7/1982 | Escaron et al. | 166/65.1 X |
| 4,388,969 | 6/1983 | Marshall et al. | 166/65.1 X |
| 4,412,584 | 11/1983 | Brandell | 166/242 X |
| 4,506,729 | 3/1985 | Davis, Jr. et al. | 166/242 X |
| 4,538,838 | 9/1985 | Pringle | 285/91 |
| 4,603,578 | 8/1986 | Stoltz | 166/242 X |
| 4,649,995 | 3/1987 | Read | 166/242 X |
| 4,776,396 | 10/1988 | Studholme | 166/242 X |
| 4,862,965 | 9/1989 | Pringle | 166/242 X |

FOREIGN PATENT DOCUMENTS

| | | |
|---|---|---|
| 0233038 | 8/1987 | European Pat. Off. . |
| 1229934 | 12/1966 | Fed. Rep. of Germany . |
| 1234163 | 2/1967 | Fed. Rep. of Germany . |
| 2607958 | 6/1988 | France . |
| WO89/08769 | 9/1989 | PCT Int'l Appl. . |

*Primary Examiner*—Thuy M. Bui
*Assistant Examiner*—Frank S. Tsay
*Attorney, Agent, or Firm*—Bacon & Thomas

[57] ABSTRACT

A production tube which includes at least one substantially tubular tube element and a hydraulic line. The tube element is provided with a longitudinal groove for receiving the hydraulic line.

4 Claims, 2 Drawing Sheets

PRODUCTION TUBE WITH INTEGRATED HYDRAULIC LINE

BACKGROUND OF THE INVENTION

The present invention relates to a production tube with an integrated hydraulic line.

When an oil well is put into production the standards of safety stipulate that the well head must be equipped with a subsurface safety valve arranged in the well at a depth of about 30 m under the surface (ground or sea bed). This valve is intended to close off the well in the case of an incident, and in the majority of installations is hydraulically actuated.

In a general way, the safety valve arranged at depth is designed to have a closed rest position, the valve being held in an open position under the effect of the hydraulic pressure sent from the surface. In the case of an incident, the hydraulic pressure is purged, which results in the closing of the valve. Thus, in the case of destruction of the well head, the safety valve closes automatically.

The hydraulic passage is constituted, in a conventional way, by a hydraulic conduit of small diameter —for example 6 mm—which is arranged outside the production tubes between the valve and the well head which is arranged either on the surface or at the bottom of the sea. However, the hydraulic line has to be put in place on the tubes before the installation of the latter into the well. This procedure has numerous disadvantages.

The presence of a hydraulic line on the outside of a tube which is lowered into a well means that the line is at risk of mechanical damage or even crushing as a result of more or less violent contacts between the tube and the casing, or even indeed on passing into the blowout preventer. The resultant hydraulic leak necessitates a costly loss of time especially for offshore wells in order to effect the replacement of the damaged conduit. Still more serious, this leak can come to light much later, then requiring intervention with an apparatus which is especially hired for the purpose. Moreover, the hydraulic conduit, arranged between the tubes and the casing, is in an environment which can be or can become corrosive, constituted, for example, by brine, by sulphate reducing bacteria, by traces of corrosive gas etc., an environment which can attack the hydraulic conduit in the more or less long term.

Another problem is found at the level of the safety closing devices which are configured to close off the well with the production tubes in the well. These closing devices are equipped with semi-circular jaws which interact in a leakproof way with the outer surface of the tube. The presence of the hydraulic conduit on this outer surface can give rise to leaks at the level of the jaws or deterioration of the latter.

It has already been proposed to overcome these drawbacks with an assembly formed by two tubes arranged concentrically, the hydraulic fluid passing through the annular space formed between the tubes. Apart from the volume of fluid necessitated by this configuration, this concept presents serious drawbacks, for example on the level of the leaktightness and of the coupling between the concentric elements.

Metal protectors or protectors in elastomer have also been proposed, which are mounted, at intervals, around tubes with the hydraulic line rigidly embedded and intended to protect the conduit from mechanical impacts. This type of device cannot resolve all the drawbacks set out above.

SUMMARY OF THE INVENTION

The present invention has as its aim a production tube with an integrated hydraulic line which is adapted to overcome these drawbacks, and which is of simple construction and enhanced reliability.

In order to do this, the invention provides a production tube comprising at least one tube element of substantially tubular form and a hydraulic line, characterized in that the tube element is provided with a longitudinal groove in which is arranged the hydraulic line.

Other characteristics and advantages of the present invention will appear more clearly on reading the description which follows, given with reference to the attached drawings in which:

DETAILED DESCRIPTION OF A PREFERRED EMBODIMENT

Figure 1:
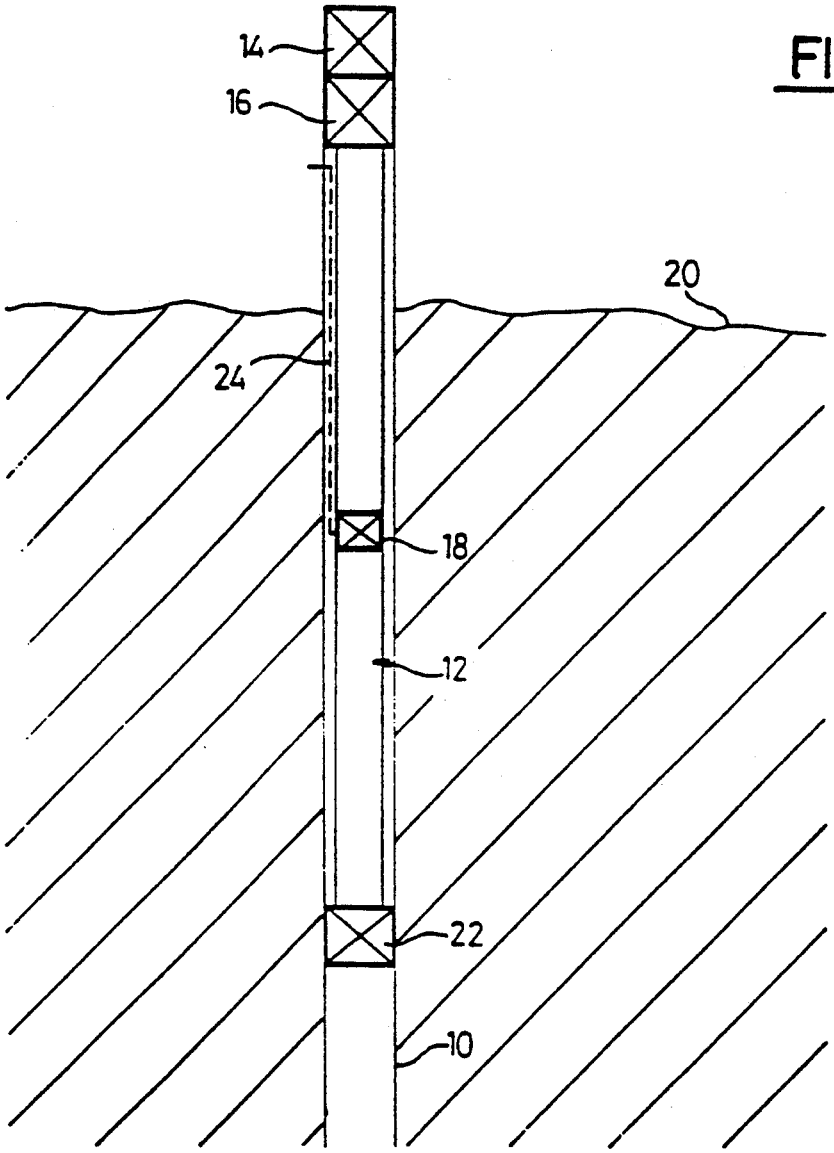
FIG. 1 is a schematic view of an offshore well fitted with a completion of known type.

In FIG. 1 is represented, schematically, an eruptive production well of known type formed by a production reservoir 10 and in which is arranged a column of production tubes, represented at 12. A well head constituted by valves 14 and 16 is mounted in a conventional way on the upper part of the column 12. An antieruption device or safety valve 18 is mounted on the column 12 at least 30 meters below ground level or the level of the sea bed 20.

This safety valve 18, mounted at the end of the tubing 12, is intended to be controlled by a hydraulic line 24 which extends along some tubes 12 outside the latter.

Figure 3:
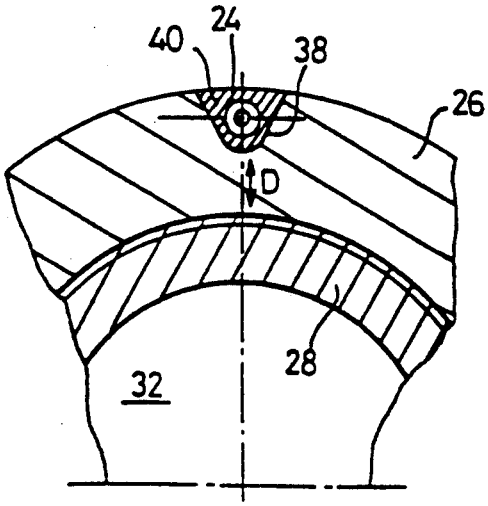
FIG. 3 is a partial section taken along the line III—III of FIG. 2.
Figure 2:
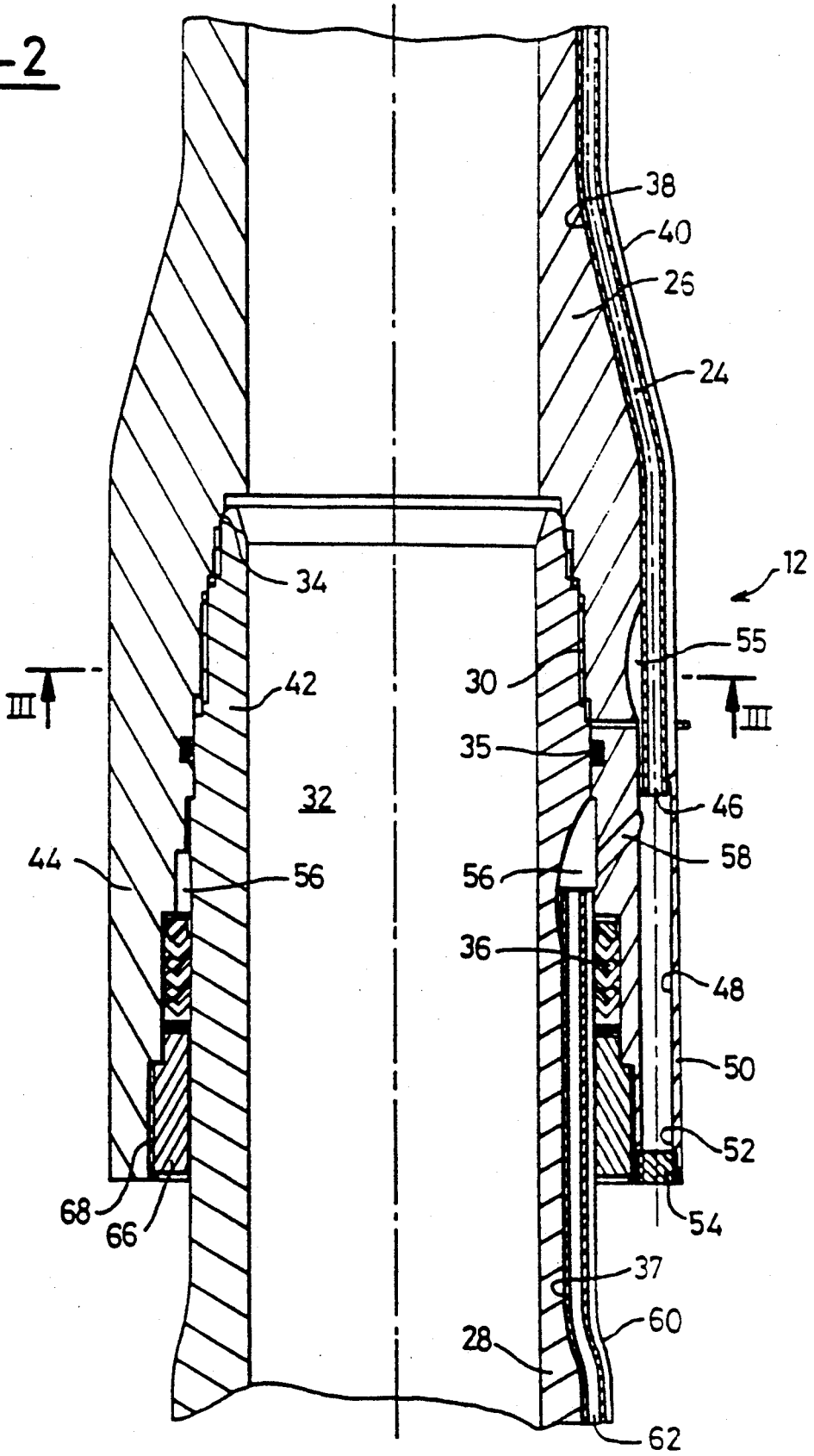
FIG. 2 is a view in longitudinal section of a well tube according to the invention.

According to the invention, the tube represented in FIG. 2 incorporates an integrated hydraulic line. In the example illustrated, the tube 12 is formed by two elements shown partially at 26 and 28 which are connected together by threads 30. An axial passage 32, formed inside the tube 12, is rendered leaktight in a general way by this thread which comprises a metal/metal bearing surface 34. The element 26 of the tube 12 is formed with a longitudinal groove 38 in its outer surface 40, a groove which has a cross-section which is substantially in the form of a U—see FIG. 3. The hydraulic line 24 formed by a metal tube having an outer diameter of about 6 mm is arranged along the groove 38. As represented in FIG. 3, the groove 38 is filled with solder 40 which serves to retain the hydraulic line 24 in place and to restore a continuous outer surface to the element 26. In order to conform to safety standards, the thickness —D—of the element 26 or 28 which is delimited by the bottom of the groove 38 corresponds to the thickness of a production tube of the conventional type.

In order that the axial passage 32 keeps a constant cross-section, the element 26 of the tube 12 incorporates a part 44 of enlarged diameter. The groove 38 and the hydraulic line 24 follow the surface of the element 26 until the extremity 46 of the line 24 penetrates into a longitudinal passage 48 bored in the wall 50 of the element 26. The passage 48 is closed off at its extremity 52 which is distant from the hydraulic line 24 by a threaded stopper 54. The extremity 46 of the line is in hydraulic communication with a hollow chamber 56 formed between the two elements 26 and 28 a passage 58 formed in the element 26.

The element 28 of the tube 12 is provided with a longitudinal groove 60 which is substantially similar to groove 38 of the element 26 and incorporates a hydraulic line 62 mounted as indicated below for the hydraulic line 24.

Two recesses 55 and 56 are respectively formed into the elements 26 and 28 in order to ensure a perfect circular weld around the conduit 24 and 62 and to avoid any longitudinal migration under the solder of the grooves 40 and 60. In addition, a set of "chevron" joints 36 isolates the hydraulic oil from the liquid present in the annular space between the production column and the casing. A toric joint 35 reinforces the leaktightness of the thread 30 and prevents the presence of any threaded joint lubricant in the hydraulic conduit.

In this way, a continuous hydraulic passage is provided between the hydraulic lines 24 and 62. The joint 36 is held in position by an annular collar 66 mounted in the element 26 by thread 68.

Thus, by virtue of the present invention a continuous hydraulic line is provided along the tube 12 and at the level of the connection of two tubes, a line which is entirely protected from attacks from its environment or during its installation but which leaves the tube with a continuous external surface. This invention also reduces the losses of time during the installation or removal of a production well completion.

We claim:

1. A production tube adapted for use in a well comprising at least one tube element of substantially tubular form and an hydraulic line, wherein the tube element is generally circular in cross-section and is provided with a longitudinal groove, formed in an outer peripheral surface of the tube element, in which is arranged the hydraulic line, said hydraulic line being completely enclosed within said groove by a filler material which fills said groove and is flush with the outer peripheral surface of the tube element.

2. The production tube according to claim 1, wherein the groove has a cross-section which is substantially U-shaped.

3. The production tube according to claim 1, wherein the tube element includes a female extremity provided with a joint for isolating the hydraulic line from an annular space of the well.

4. The production tube according to claim 3, further comprising an hydraulic passage and a second tube element which is linked to said at least one tube element by a petroleum type thread, said tube element being provided with a second hydraulic line, one of the tube elements being equipped with a chamber which is in hydraulic communication with the hydraulic passage, said chamber and said hydraulic passage providing fluid communication between said hydraulic lines when the two tube elements are connected together.

* * * * *